US010969155B2

(12) United States Patent
Chae et al.

(10) Patent No.: US 10,969,155 B2
(45) Date of Patent: Apr. 6, 2021

(54) REFRIGERATOR

(71) Applicant: LG ELECTRONICS INC., Seoul (KR)

(72) Inventors: Sunam Chae, Seoul (KR); Kyungseok Kim, Seoul (KR); Soyoon Kim, Seoul (KR); Kyunghun Cha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 99 days.

(21) Appl. No.: 15/994,538

(22) Filed: May 31, 2018

(65) Prior Publication Data

US 2018/0347886 A1 Dec. 6, 2018

(30) Foreign Application Priority Data

Jun. 2, 2017 (KR) ..... 10-2017-0069094

(51) Int. Cl.
*F25D 17/04* (2006.01)
*F25D 17/06* (2006.01)
*F25D 17/08* (2006.01)

(52) U.S. Cl.
CPC ..... *F25D 17/045* (2013.01); *F25D 17/062* (2013.01); *F25D 17/065* (2013.01); *F25D 17/08* (2013.01); *F25D 2317/061* (2013.01); *F25D 2317/062* (2013.01); *F25D 2317/0671* (2013.01); *F25D 2317/0672* (2013.01)

(58) Field of Classification Search
CPC ..... F25D 17/045; F25D 17/062; F25D 17/08; F25D 17/065; F25D 17/0671
See application file for complete search history.

(56) References Cited

U.S. PATENT DOCUMENTS 5,546,759 A * 8/1996 Lee ..... F25D 17/065 62/441
5,765,388 A * 6/1998 Jeon ..... F25D 17/065 62/408
5,875,642 A * 3/1999 Lee ..... F25D 17/045 62/256
5,941,087 A * 8/1999 Lee ..... F25D 17/045 62/256
5,979,174 A * 11/1999 Kim ..... F25D 17/065 62/404
5,992,164 A * 11/1999 Kim ..... F25D 17/045 62/186
6,694,761 B2 * 2/2004 Cho ..... F25D 17/045 236/49.3

(Continued)

FOREIGN PATENT DOCUMENTS

KR 10-0189103 6/1999

*Primary Examiner* — Kun Kai Ma
(74) *Attorney, Agent, or Firm* — KED & Associates LLP

(57) ABSTRACT

A refrigerator includes a cabinet including a storage compartment, a storage compartment door to open or close the storage compartment, a cool air duct provided in the storage compartment and positioned at an upper portion of the storage compartment to discharge cool air to the storage compartment, a damper to adjust an amount of cool air introduced into the cool air duct, and a door discharge duct communicating with the cool air duct and extending in a front-rear direction toward the storage compartment door to discharge cool air received from the cool air duct to the storage compartment door.

19 Claims, 13 Drawing Sheets

(56) References Cited

U.S. PATENT DOCUMENTS

| | | | | |
|---|---|---|---|---|
| 6,732,537 | B1 * | 5/2004 | Anell | F25C 1/04 62/353 |
| 10,240,851 | B2 * | 3/2019 | Kim | F25D 17/065 |
| 2003/0041606 | A1 * | 3/2003 | Kim | F25D 17/045 62/186 |
| 2005/0126205 | A1 * | 6/2005 | Schmid | F25D 17/065 62/407 |
| 2005/0138952 | A1 * | 6/2005 | Jeong | F25D 17/065 62/407 |
| 2007/0119198 | A1 * | 5/2007 | Scrivener | F25D 17/045 62/187 |
| 2009/0113924 | A1 * | 5/2009 | Bae | F25D 17/065 29/890.035 |
| 2010/0126201 | A1 * | 5/2010 | Seo | F25D 17/065 62/340 |
| 2011/0100046 | A1 * | 5/2011 | Choi | F25C 5/22 62/320 |
| 2013/0033163 | A1 * | 2/2013 | Kang | F25D 23/025 312/405.1 |
| 2018/0112905 | A1 * | 4/2018 | Cho | F25D 17/062 |
| 2018/0172336 | A1 * | 6/2018 | Bae | F25D 17/062 |
| 2019/0368801 | A1 * | 12/2019 | Song | F25D 17/062 |

* cited by examiner

REFRIGERATOR

CROSS-REFERENCE TO RELATED APPLICATIONS

This application claims priority under 35 U.S.C. § 119 to Korean Patent Application No. 10-2017-0069094 filed on Jun. 2, 2017, whose entire disclosure is hereby incorporated by reference.

BACKGROUND

1. Field

The embodiment relates to a refrigerator, and more specifically a refrigerator to maintain a more consistent internal temperature.

2. Background

A refrigerator is a home appliance that provides a storage compartment to store foods or other items and maintains the storage compartment substantially at a lower temperature. For example, the home refrigerator may include one or more storage compartments that are maintained in a temperature range that varies between an upper limit and a lower limit based on a set temperature. For example, the refrigerator may be controlled to activate a freezing cycle in which a refrigerant is selectively compressed, phased changed, and decompressed to cool the storage compartment when the temperature of the storage compartment rises to reach or exceed the upper limit temperature and to stop the freezing cycle when the temperature of the storage compartment reaches the lower limit temperature.

Korean Unexamined Patent Publication No. 1997-0022182 (issued as KR 10-0189103) describes a control method of maintaining a storage compartment of a refrigerator at a substantially constant temperature. According to this reference, when the temperature of the storage compartment is higher than a set temperature, a compressor and a fan are driven while a damper in a cool air passage to the storage compartment is fully open. When the temperature of the storage compartment is decreased to the set temperature, the driving of the compressor and/or the fan is stopped while the damper of the storage compartment is closed.

In this repeated cycle, in which the compressor is driven when the temperature of the storage compartment of the refrigerator rises to equal or exceed a set temperature, and the compressor then is deactivated when the temperature of the storage compartment decreases to be equal to or below the set temperature, power consumption may be increased when the compressor is re-driven. Furthermore, when the damper is fully open while the storage compartment is being cooled by the driven compressor, there is an increased probability of excessively supplying cooling air into the storage compartment. Accordingly, the storage compartment may be excessively cooled below a desired temperature, and the storage compartment may not be maintained at a constant temperature.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Referring to FIGS. 1 to 4, according to an embodiment of the present disclosure, a refrigerator 1 may include a cabinet 11 having a storage compartment formed therein and a storage compartment door coupled to the cabinet 11 to open or close the storage compartment. The cabinet 11 may include an inner case and an outer case, and the inner case and the outer case may include insulating materials.

Figure 3:
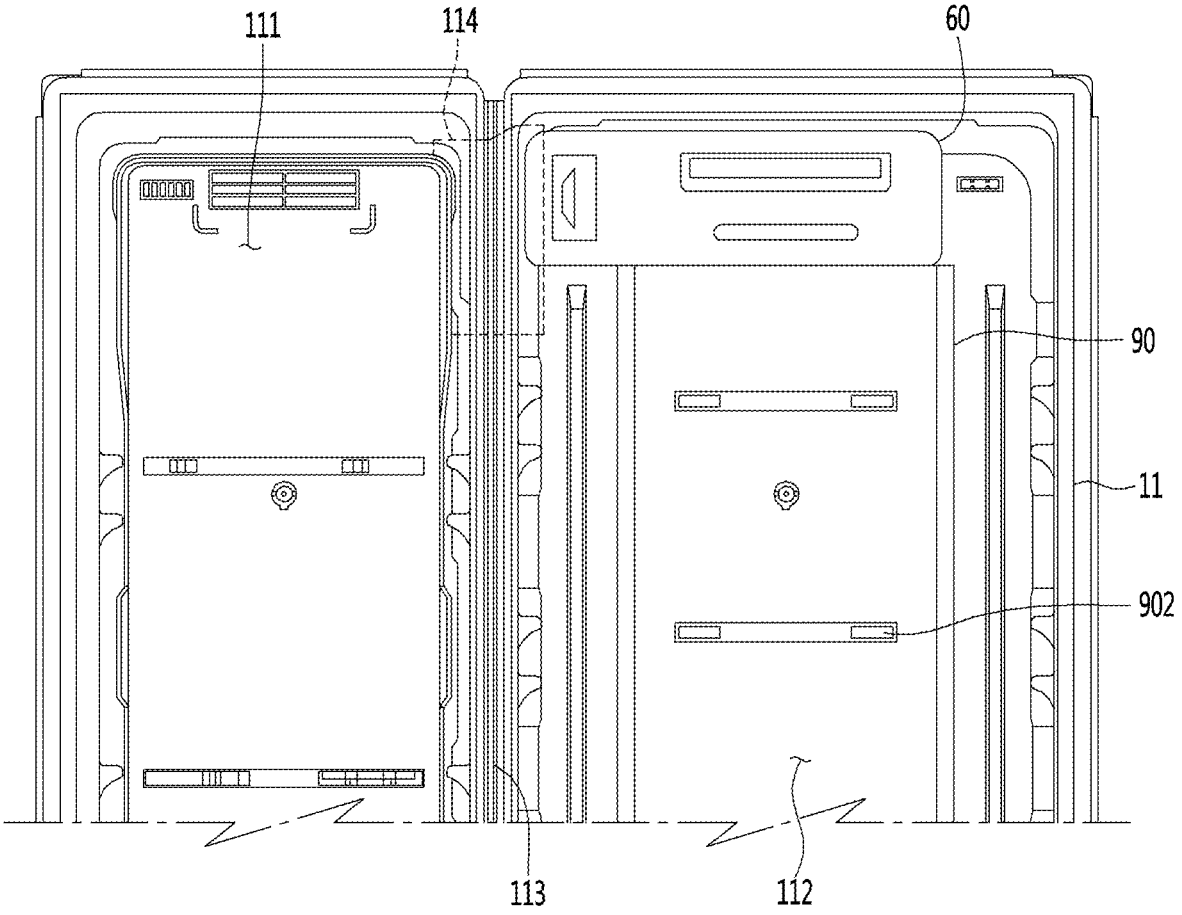
FIG. 3 is a view illustrating the inner part of a cabinet according to the present embodiment.

The inner case may define two or more different compartments. For example, the storage compartment may include a freezing compartment 111 and a refrigerating compartment 112. The freezing compartment 111 and the refrigerating compartment 112 may store articles, such as food at relatively low temperatures. In various examples, the freezing compartment 111 and the refrigerating compartment 112 may be provided as left and right compartments or upper and lower compartments in the interior of the cabinet 11. The freezing compartment 111 and the refrigerating compartment 112 may be separated by a partition wall 113. FIG. 3 illustrates a configuration in which the freezing compartment 111 and the refrigerating compartment 112 are provided, respectively, in left and right sections of the interior of the cabinet 11, and are separated by the partition wall 113 that extends vertically.

The refrigerator 1 may also include at least one freezing compartment door 15 to open or close the freezing compartment 111 and at least one refrigerating compartment door 16 to open or close the refrigerating compartment 112. The refrigerating compartment door 16 may further include, but is not limited to, a sub-door 17 that enables a user to withdraw an article stored in the refrigerating compartment door 16 without opening the refrigerating compartment door 16.

In addition, the partition wall 113 may include a connection fluid passage 114 serving as a cooling air passage to supply cooling air to the refrigerating compartment 112. For example, the connection fluid passage 114 may enable cooling air to flow from the freezing compartment 111 and/or a freezing cycle 20 (see FIG. 2). The refrigerator 1 may include a cooling air duct 60 to receive cooling air through the connection fluid passage 114 and a plurality of discharge ducts 70 and 90 communicating with the cooling air duct 60 for discharging cooling air to the refrigerating compartment 112.

The cooling air duct 60 may include a damper 12 to control the flow of cooling air through the cooling air duct 60. The damper 12 may be actuated by a damper driving unit (or damper driving motor) 13. For example, the damper 12 may rotate based on receiving a force from the damper driving unit 13. An amount of cooling air to be introduced into the cooling air duct 60 through the connection fluid passage 114 may be adjusted depending on an open angle of the damper 12.

In addition, the refrigerator 1 may further include a freezing cycle 20 to cool the freezing compartment 111 and/or the refrigerating compartment 112. In detail, the cooling cycle 20 may include a compressor 21 to compress a refrigerant to a high temperature and high pressure vapor-phase refrigerant, a condenser 22 to condense the refrigerant, which has passed through the compressor 21, to a high temperature and high pressure liquid-phase refrigerant, an expansion member (or expansion) 23 to expand the refrigerant which has passed through the condenser 22, and an evaporator 24 to evaporate the refrigerant which has passed through the expansion member 23.

In addition, the evaporator 24 may include a separate evaporator for the freezing compartment 112. Thus, while the present embodiment has been described in an example that includes one evaporator 24, the present disclosure may also be applicable to another type of refrigerator that includes a freezing compartment evaporator to cool the freezing compartment 112 and a separate refrigerating compartment evaporator to cool the refrigerating compartment 111.

In addition, the refrigerator 1 may include a fan 26 that allows air to flow toward the evaporator 24 and a fan motor 25 to drive the fan 26 to circulate cooling air in the freezing compartment 111 or to otherwise circulate cooling air to or from the evaporator 24.

Figure 1:
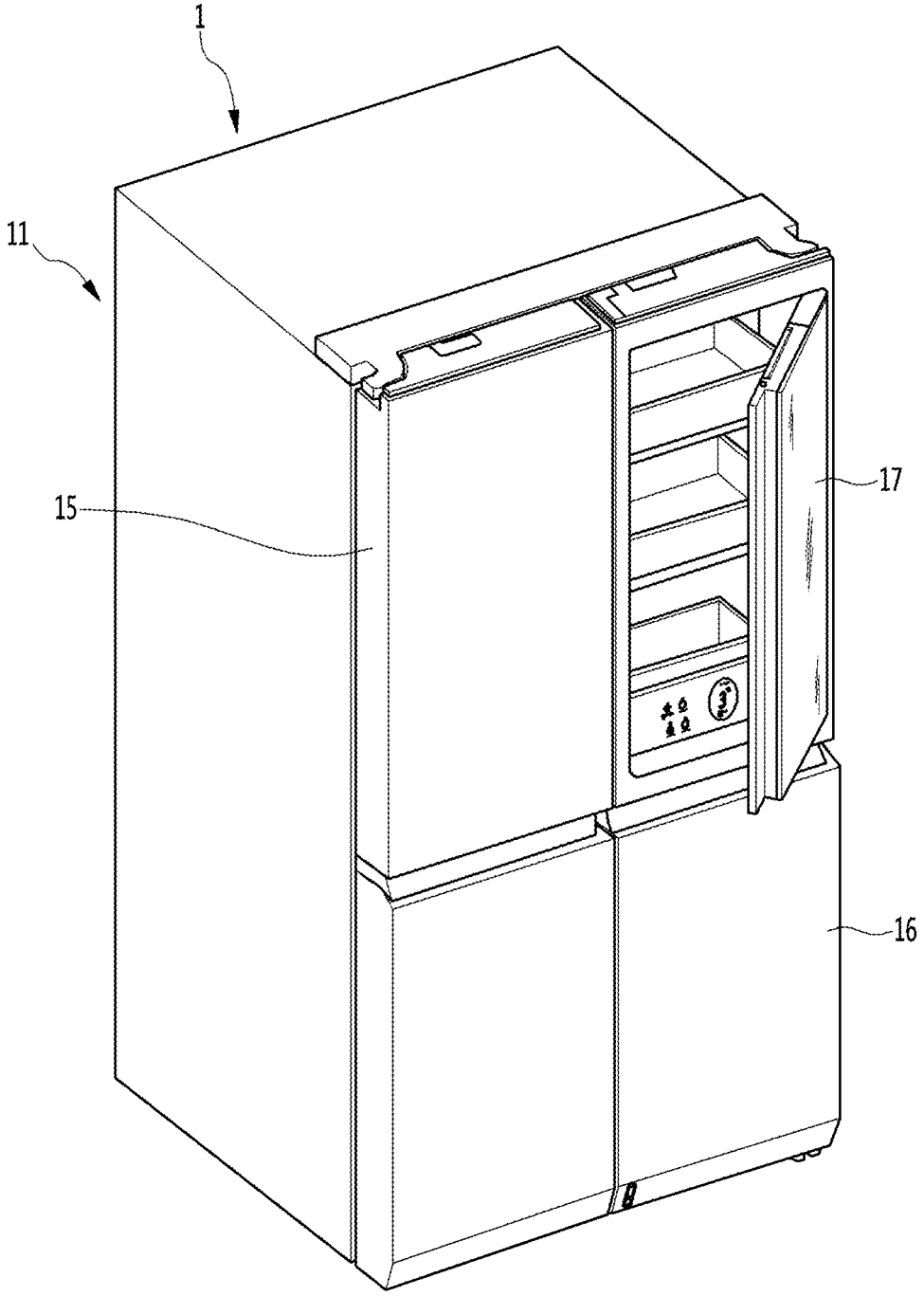
FIG. 1 is a perspective view of a refrigerator according to an embodiment of the present disclosure.
Figure 2:
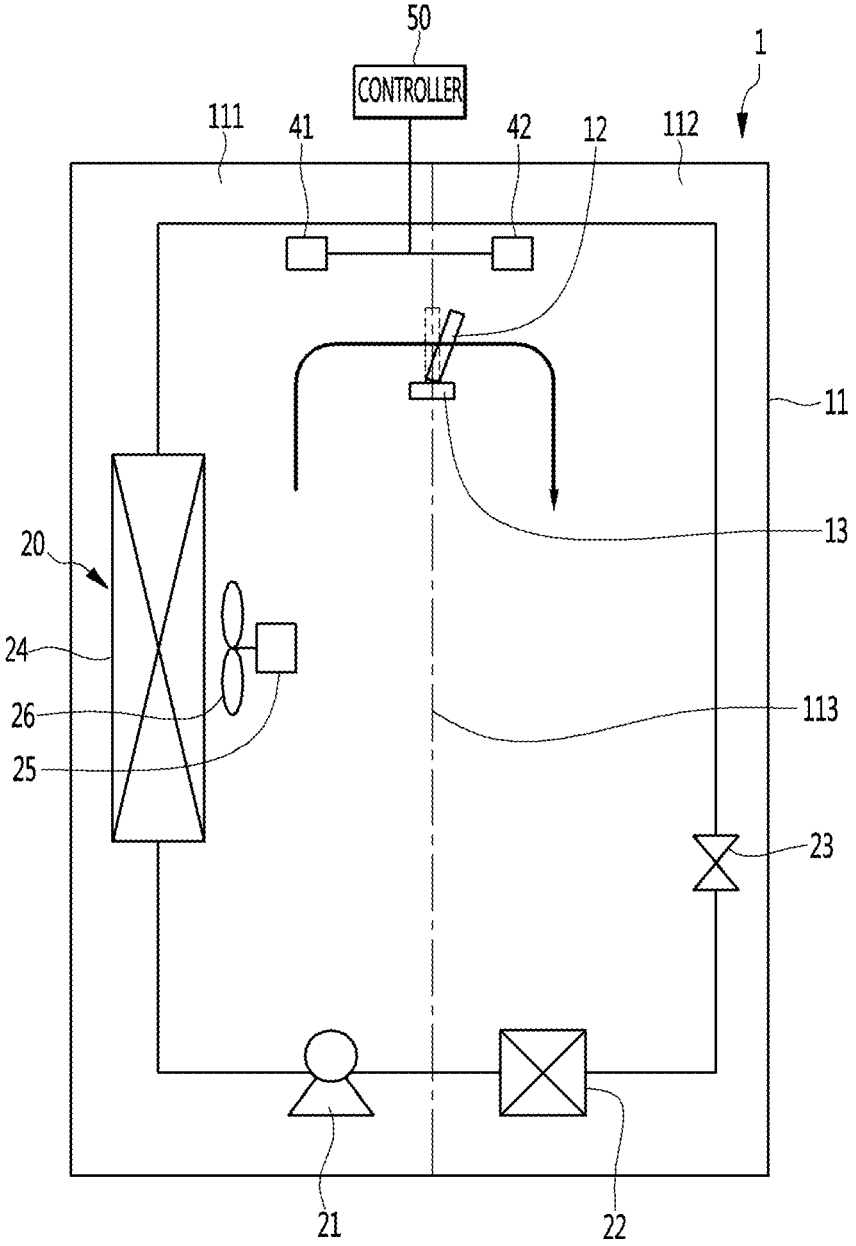
FIG. 2 is a view schematically illustrating the configuration of the refrigerator according to an embodiment of the present disclosure.

According to the configuration shown in FIG. 2, the compressor 21 and the fan motor 25 may be activated to supply the cooling air to the freezing compartment 111. To supply the cooling air to the refrigerating compartment 112, the compressor 21, the fan motor 25, and the damper 12 may be operated. For example, the compressor 21 and the fan motor 25 may be activated to generate the cooling air, and the damper 12 may be selectively rotated to open a flow path so that the cooling air may be provided to the refrigerating compartment 112. In the following discussion, the compressor 21, the fan motor 25, and the damper 12 may be collectively referred to as a "cooling air supplier" to operates to supply cooling air to the storage compartment, such as the refrigerating compartment 112.

The refrigerator 1 may include a freezing compartment temperature sensor 41 to sense the temperature of the freezing compartment 111, a refrigerating compartment temperature sensor 42 to sense the temperature of the refrigerating compartment 112, and a controller 50 to control the cooling air supplier based on the temperatures sensed by the freezing compartment temperature sensor 41 and the refrigerating compartment temperature sensor 42.

The controller 50 may selectively activate control at least one of the compressor 21 or the fan motor 25 to maintain the temperature of the freezing compartment 111 to a target temperature. For example, the controller 50 may modify the activity level of the compressor 21 while the fan motor 25 is operating at a constant speed. In another example, the controller 50 may control the motion (e.g., the rotation speed) of the fan motor 25 while the compressor 21 is operated at a consistent level.

The controller 50 may control at least one of the compressor 21, the fan motor 25, and a damper driving unit 13 to modify the temperature of the refrigerating compartment 112 based on a target temperature. For example, the controller 50 may selectively activate the damper driving unit 13 adjust the open angle of the damper 12 while the compressor 21 and the fan motor 25 are operating at constant levels.

In detail, hereinafter, a particular temperature higher than the target temperature of the refrigerating compartment 112 may be referred to as a first reference temperature (or upper reference temperature), and another particular temperature lower than the target temperature of the refrigerating compartment 112 may be referred to a second reference temperature (or lower reference temperature). In addition, hereinafter, the range between the first reference temperature and the second reference temperature may be referred to as a setting temperature range. In addition, a specific temperature in the range between the first reference temperature and the second reference temperature may be referred to as a third reference temperature. The third reference temperature may be, for example, a target temperature or an average temperature of the first reference temperature and the second reference temperature.

The controller 50 may manage the cooling air supplier such that the target temperature of the refrigerating compartment 112 may be maintained in the set temperature range.

Figure 5:
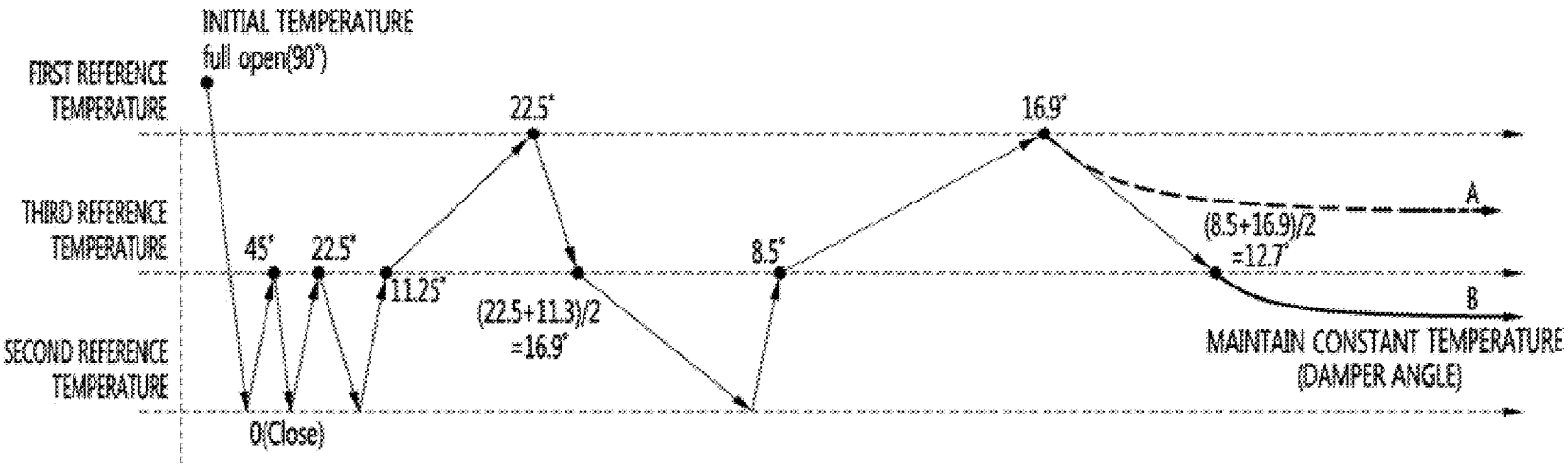
FIG. 5 is a graph illustrating the variation in the temperature of the refrigerating compartment and the variation in an open angle of a damper according to an embodiment of the present disclosure.
Figure 6:
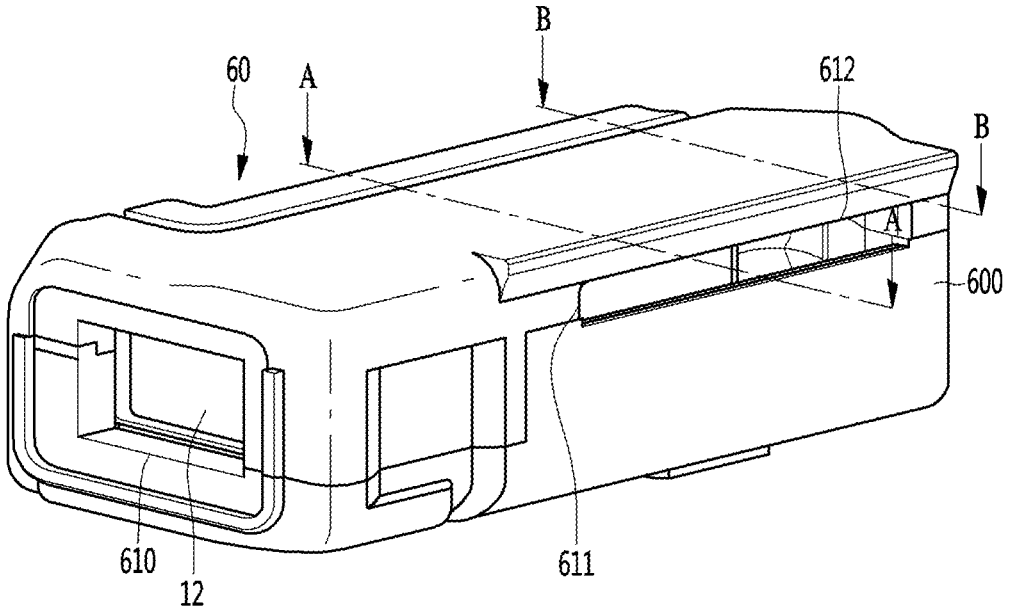
FIG. 6 is a perspective view of a cooling air duct according to an embodiment of the present disclosure.
Figure 7:
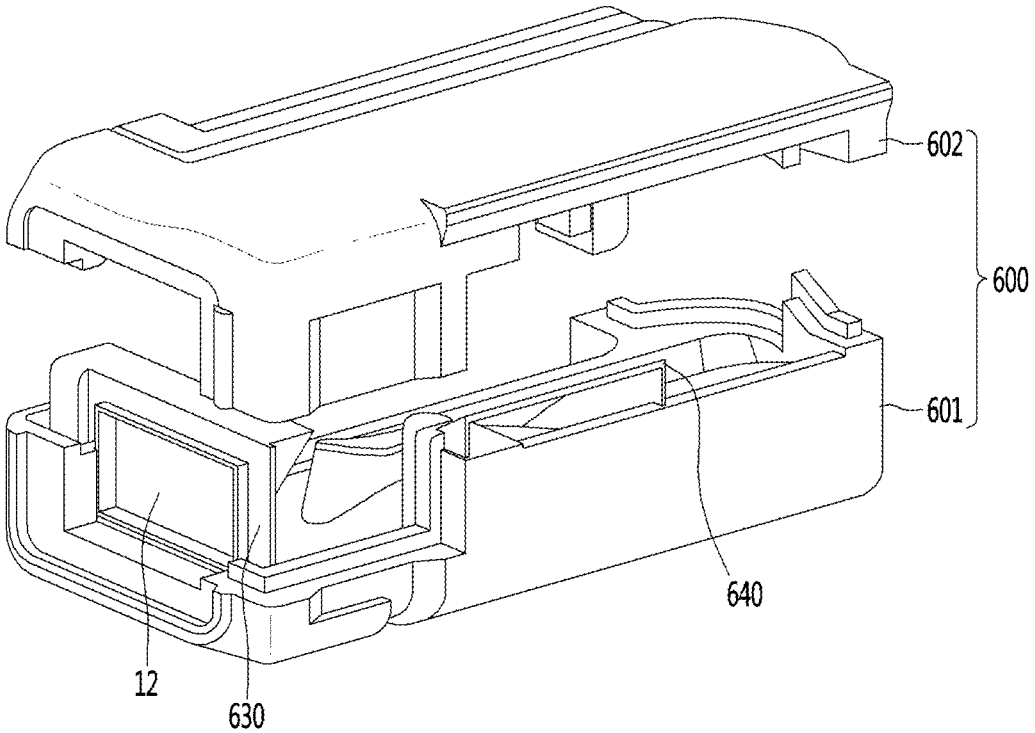
FIG. 7 is an exploded perspective view of the cooling air duct of FIG. 6.

Hereinafter, a constant-temperature control method of the refrigerating compartment 112 will be described. The constant-temperature control method will be described with respect to a graph in FIG. 5 illustrating a sample variation in the temperature of the refrigerating compartment 112 and an associated sample variation in an open angle of the damper 12, according to an embodiment of the present disclosure. In the following discussion, the angle of the damper 12 may be measured relative to a line normal a direction of air flow within a path that may include damper 12 and/or a line normal to a sidewall of the path. For example, when the angle of the damper 12 is 0 degrees, the damper 12 is perpendicular to and substantially blocks the path of the air flow, and when the angle of the damper 12 is 90 degrees, the damper 12 is parallel to and substantially opens the path of the air flow.

Referring to FIGS. 1 to 5, the controller 50 may manage the damper 12 (e.g., selectively activate the damper driving unit 13) to fully open a fluid passage (for example, the angle of the damper 12 may become 90 degrees) when the initial temperature of the refrigerating compartment 112 is equal to or greater than the first reference temperature, during the constant-temperature control of the refrigerating compartment 112. After the fluid passage is open by the damper 12, the cooling air of the freezing compartment 111 may be introduced into the cooling air duct 60 through the connection fluid passage 114. The cooling air introduced into the cooling air duct 60 may be divided between at least one of a plurality of discharge ducts 70 and 90 and discharged to the refrigerating compartment 112.

When the cooling air is supplied into the refrigerating compartment 112, the temperature of the refrigerating compartment 112 may decrease due to the cooling air. When the temperature of the refrigerating compartment 112 drops to the second reference temperature or less, the controller 50 may manage the damper 12 to rotate to a minimum open angle (e.g., 0 degrees) or otherwise allow the fluid passage to be closed. Then, the temperature of the refrigerating compartment 112 may increase since the damper 12 is positioned to block additional cooling air from being supplied to the refrigerating compartment 112.

When the temperature of the refrigerating compartment 112 reaches the third reference temperature (between the first and second reference temperatures), the controller 50 may manage the damper 12 to open the fluid passage at an angle smaller than a previous open angle. For example, the controller 50 may control the open angle of the damper 12 based on the following Equation 1.

$$\text{New Open Angle} = n * \text{Previous Open Angle} \quad \text{(Eq. 1)}$$

The value of the percentage "n" may be in the range of 0 to 100. The following discussions, n is given a value of 50, but it should be appreciated that other values for n may be used. For example, after the initial cooling, the damper 12 may be rotated to an angle of 45 degrees, or half of the previous open angle (90 degrees), such that some cooling air may enter and cool the refrigerating compartment 112 via the partially opened air flow passage. However, an amount of cooling air passing though the fluid passage when the damper 12 has an open angle of 45 degrees is less than am amount of cooling air passing though the fluid passage when the damper 12 has an open angle of 90 degrees.

In addition, when the temperature of the refrigerating compartment 112 decreases again to be the second reference temperature or less, the damper 12 may be actuated again to close the fluid passage or to have the minimum open angle in the fluid passage, thus cutting off or reducing a flow of the cooling air toward the refrigerating compartment 112. Later, when the temperature of the refrigerating compartment 112 again increases and reaches to the third reference temperature, the damper 12 may be actuated to have an open angle corresponding to the half (22.5 degrees) of a previous open angle (45 degrees).

In some situations, the temperature in the refrigerating compartment 112 may rise even when through the damper 12 that is rotated to at least partially open the fluid passage and the cooling air of the freezing compartment 111 is being supplied to the refrigerating compartment 112 via the fluid passage that is at least partially opened. For example, when the refrigerating compartment door 16 is opened or when foods or other items are additionally introduced into the refrigerating compartment 112, the temperature of the refrigerating compartment 112 may be increased. Accordingly, in this situation, the open angle of the damper 12 may be further controlled to allow more cooling air of the freezing compartment 111 to be supplied to the refrigerating compartment 112 to minimize, delay, or otherwise address the increase in the temperature of the refrigerating compartment 112.

Accordingly, when the temperature of the refrigerating compartment 112 is increased to the first reference temperature or more when the damper 12 partially opens the fluid passage, the open angle of the damper 12 may be adjusted back to a previous, larger open angle to allow more cooling air for flow through the damper 12.

For example, when the temperature of the refrigerating compartment 112 increases to the first reference temperature or more in after the present open angle of the damper 12 is reduced from 45 degrees to 22.5 degrees, the open angle of the damper 12 is re-adjusted back to the previous larger open angle, or 45 degrees. In another example, when the temperature of the refrigerating compartment 112 reaches the third, intermediate reference temperature after the open angle of the damper 12 is adjusted to the previous open angle, the controller 50 may rotate the damper 12 to have an open angle that is obtained through equation 2.

$$\text{New Open Angle} = (\text{Present Open Angle} + \text{Previous Open Angle}) \times a \quad \text{(Eq. 2)}$$

For example, 'a' may have a value greater than 0 and smaller than 1. In the following discussion, a may have a value of 0.5, but is not limited thereto.

For example, when the temperature of the refrigerating compartment 112 is increased to the first reference temperature or more when the open angle of the damper 12 is 11.25 degrees, as illustrated in FIG. 5, the open angle of the damper 12 may be increased. In this example, the damper 12 may be actuated to be opened to an angle of 22.5 degrees, which is the previous open angle. After a present open angle of the damper 12 is set to 22.5, and when the temperature of the refrigerating compartment 112 falls to or below the third reference temperature, the open angle of the damper 12 may be adjusted to 16.9 degrees, which is a value obtained through equation 2 as 22.5 degrees+11.25 degrees×0.5.

The constant-temperature control method as described above may prevent the damper 12 from fully opening the fluid passage to prevent excessive cooling of stored items in the refrigerating compartment 112, so that the temperature of the refrigerating compartment 112 may be stably maintained in the set temperature range.

Meanwhile, according to the above-described constant-temperature control method, since the damper 12 is controlled to have a smaller open angle, an amount of cooling air supplied from the freezing compartment 111 to the refrigerating compartment 112 may be relatively smaller than an amount of cooling air supplied when the damper 12 is fully open. To achieve a more uniform temperature within the refrigerating compartment 112 even while using the smaller amount of cooling air, the cooling air may be more uniformly supplied throughout the refrigerating compartment 112. For example, when the refrigerating compartment door 16 includes the sub-door 17, the cooling air may be smoothly supplied to the upper portion of the refrigerating compartment door 16.

Figure 4:
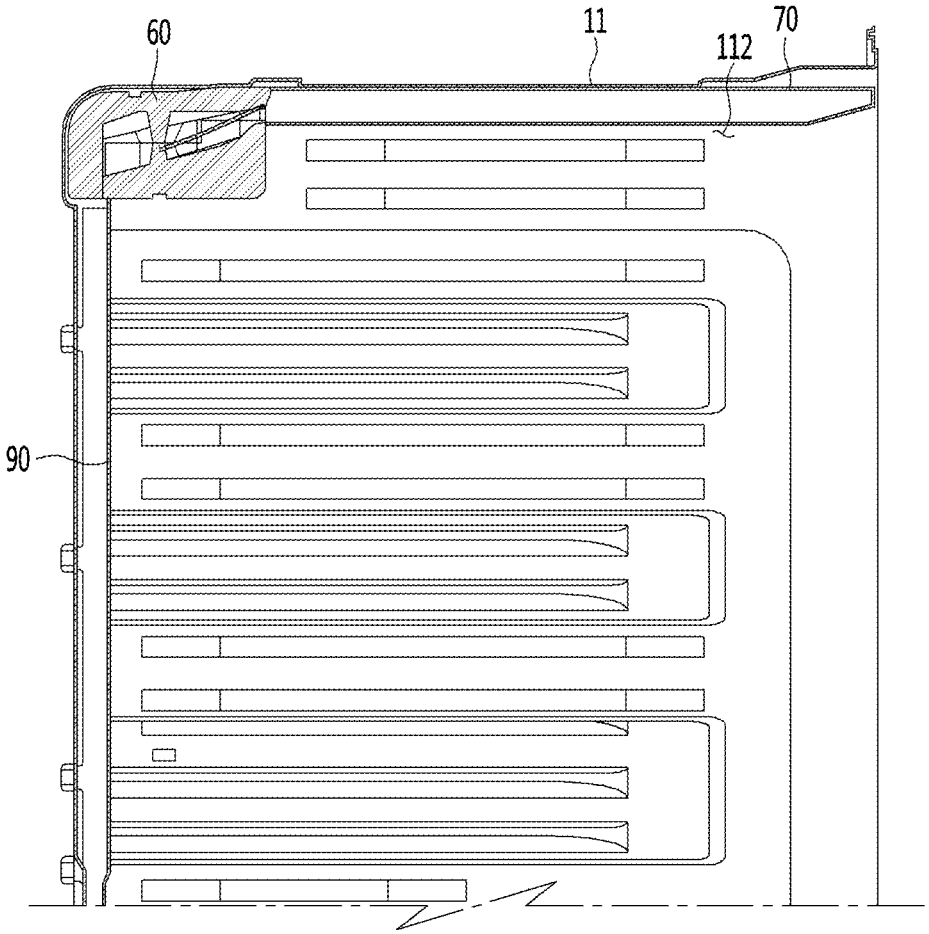
FIG. 4 is a view illustrating a cooling air duct and a discharge duct arranged in a refrigerating compartment.

Referring to FIGS. 3 and 4, the refrigerating compartment 112 may include the cooling air duct 60 to distribute the cooling air and the discharge ducts 70 and 90 to discharge the cooling air, which is supplied from the cooling air duct 60, to different sections of the refrigerating compartment 112. The discharge ducts 70 and 90 may include a door discharge duct 70 to guide the cooling air toward the refrigerating compartment door 16 and a rear discharge duct 90 connected with the rear wall of the refrigerating compartment 112.

According to the present embodiment, the cooling air duct 60 and the door discharge duct 70 may be include openings in or otherwise be exposed to the interior of the refrigerating compartment 112. In another example, one or more of the cooling air duct 60 and the door discharge duct 70 may be interposed between the inner case and the outer case while communicating with the refrigerating compartment 112.

The door discharge duct 70 may discharge cooling air both toward the refrigerating compartment door 16 and an upper space of the refrigerating compartment 112. In contrast, the rear discharge duct 90 may extend vertically on a rear section of the refrigerating compartment 112 and may discharge the cooling air to the refrigerating compartment 112 through a plurality of discharge holes 902 that are vertically arranged. The door discharge duct 70 may be positioned on or near the ceiling of the refrigerating compartment 112 and may extend forward from the cooling air duct 60 toward the refrigerating compartment door 16.

Hereinafter, the cooling air duct 60 will be described in more detail. Referring to FIGS. 6 to 10, the cooling air duct 60 may include a frame 600 to form an outer appearance thereof. The frame 600 may have, but is not limited to, a substantially rectangular shape. The frame 600 may include a lower frame 601 and an upper frame 602 coupled to the lower frame 601.

The cooling air duct 60 may include a cooling air inlet 610 into which the cooling air is introduced. The cooling air inlet 610 may be formed in one side surface of the frame 600 to communicate with the connection fluid passage 114. The cooling air inlet 610 may be positioned, for example, on a left side surface of the frame 600. The damper 12 may be installed in or near the cooling air inlet 610

The cooling air duct 60 may include a first cooling air outlet 611 to discharge the cooling air introduced through the cooling air inlet 610 and a first cooling air passage 620 connecting the cooling air inlet 610 with the first cooling air outlet 611. The first cooling air outlet 611 may be formed in the front surface of the frame 600. As used herein, the "front surface" of the frame 600 may correspond to a surface facing the refrigerating compartment door 16. The first cooling air outlet 611 may be formed in the front surface of the frame 600 and may extend left and right (e.g., at a same height) on the front surface.

The cooling air duct 60 may further include a second cooling air outlet 612 to discharge the cooling air introduced through the cooling air inlet 610 and a second cooling air passage 622 connecting the cooling air inlet 610 with the second cooling air outlet 612. The second cooling air outlet 612 may also be formed in the front surface of the frame 600.

The second cooling air outlet 612 may be formed on a same plane as the first cooling air outlet 611 on the frame 600 and may be at a side of the first cooling air outlet 611. For example, the first cooling air outlet 611 and the second cooling air outlet 612 may be arranged respectively, at left and right regions of the front surface of the frame 600. For example, the first cooling air outlet 611 may be closer to the cooling air inlet 610 than the second cooling air outlet 612. In addition, the first cooling air outlet 611 and the second cooling air outlet 612 may be positioned at a common height on the front surface of the frame 600.

Figure 8:
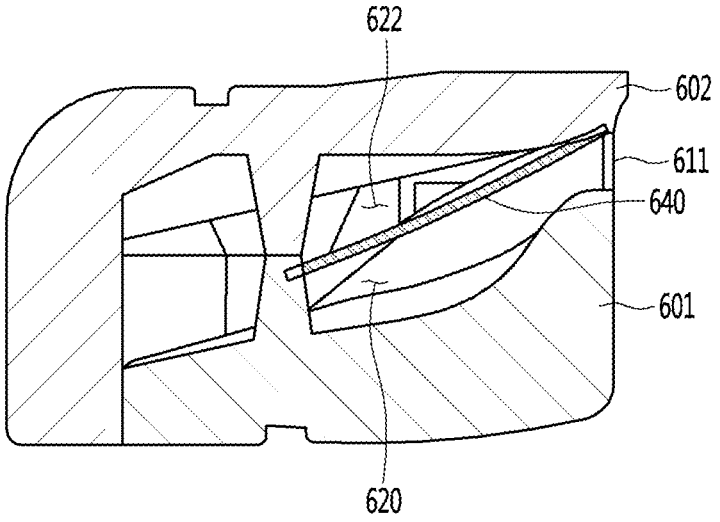
FIG. 8 is a sectional view taken along line A-A of FIG. 6.
Figure 9:
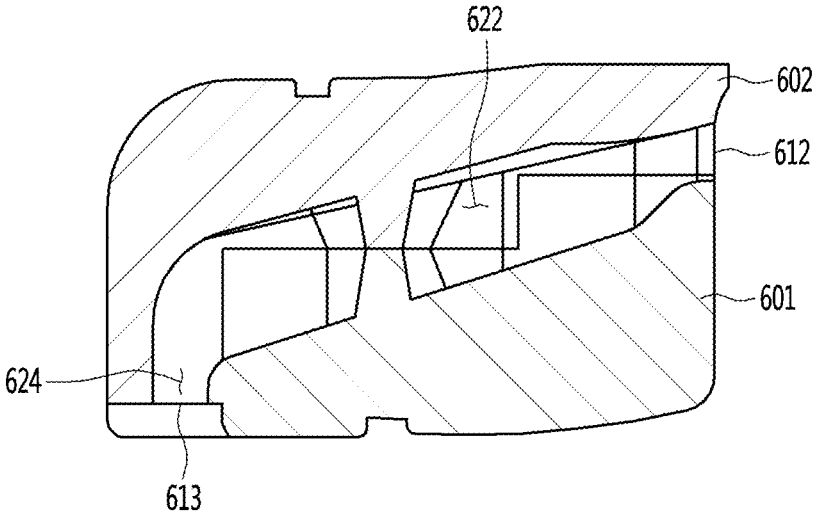
FIG. 9 is a sectional view taken along line B-B of FIG. 6.
Figure 10:
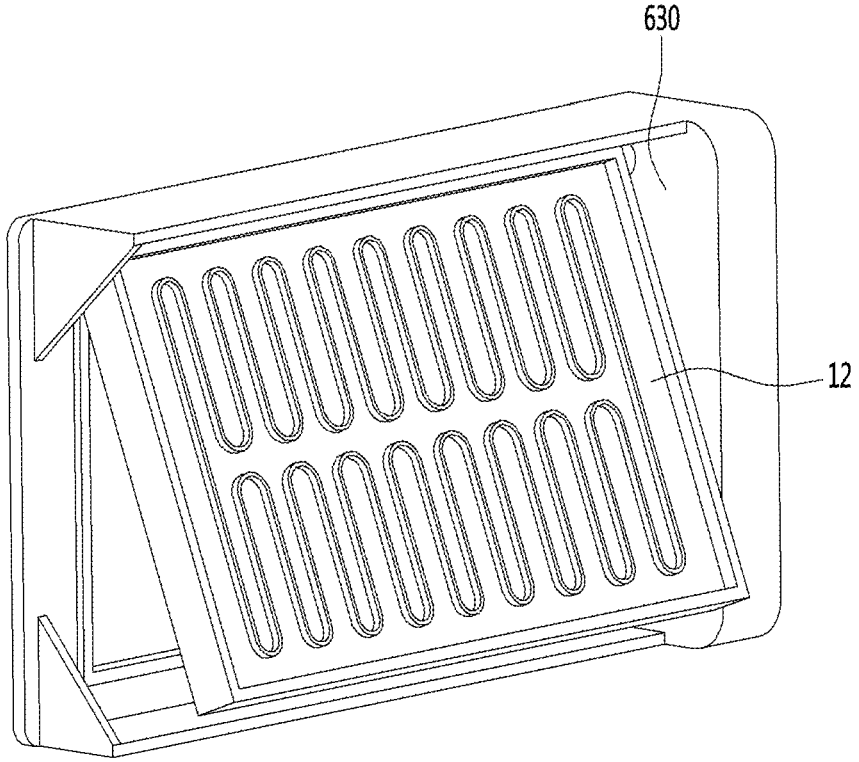
FIG. 10 is a view illustrating the state that the damper is rotated at a specific angle.

The cooling air duct 60 may further include a partition part (or partition) 640 to separate the first cooling air passage 620 and the second cooling air passage 622 from each other. The partition part 640 may vertically separate a portion of the first cooling air passage 620 from a portion of the second cooling air passage 622. for example, at least a portion of the first cooling air passage 620 may positioned under the partition part 640 and at least a portion of the second cooling air passage 622 may be positioned above the partition part 640. FIGS. 8 and 9 show different portions of the second cooling air passage 622. FIG. 8 is a sectional view taken along line A-A of FIG. 6. FIG. 9 is a sectional view taken along line B-B of FIG. 6. FIG. 8 shows that a portion of the second cooling air passage 622 overlaps the first cooling air passage 622 in a vertical direction.

Accordingly, the inlet of the second cooling air passage 622 may be positioned adjacent to the cooling air inlet 610 and positioned above the first cooling air passage 620. As described in greater detail below, the damper 12 may rotate around an upper edge (see FIG. 10), such that the cooling air is provided mostly along a bottom portion of the fluid pathway when the damper 12 is opened at relatively small angles, and the cooling air is provided along both top and bottom portions of the fluid pathway when the damper 12 is opened at relatively larger angles. Thus, the cooling air may be mostly received in lower the first cooling air passage 620 when the damper 12 is opened at relatively small angles (e.g., less than 45 degrees) and may be received in both the first cooling air passage 620 and the higher the second cooling air passage 622 when the damper 12 is opened at relatively larger angles (e.g., more than 45 degrees).

The cooling air duct 60 may further include a third cooling air passage 624 branching from the first cooling air passage 620 and a third cooling air outlet 613 to discharge cooling air toward the rear discharge duct 90. The third cooling air outlet 613 may be formed in the bottom surface of the frame 600.

A support part (or support frame) 630 may be provided on the frame 600 to rotatably support the damper 12. An upper portion of the damper 12 may be provided on the support part 630 such that the damper 12 may be rotated as a hinge. Accordingly, as the open angle of the damper 12 is increased, the height of a lower end portion of the damper 12 may be increased to allow more cooling air into the fluid passage, and to allow the cooling air into high portions of the fluid passage.

Figure 11:
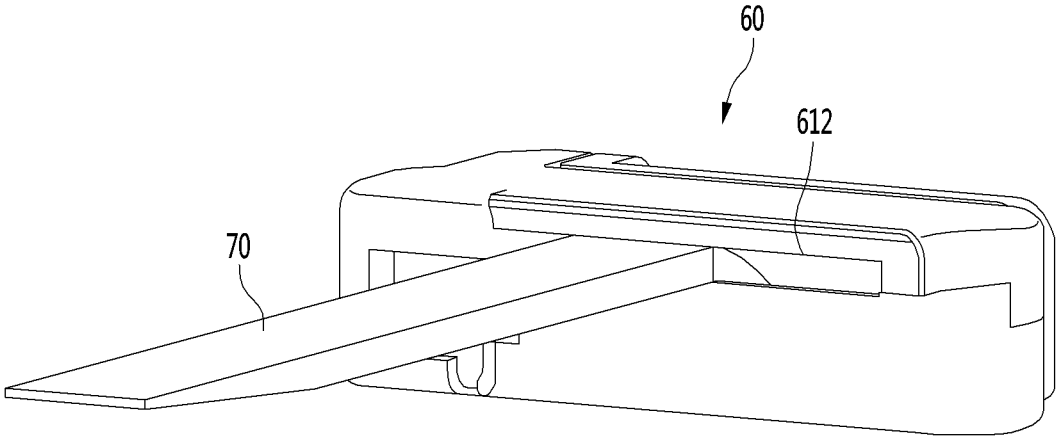
FIG. 11 is a view illustrating the state that the cooling air duct communicates with the door discharge duct according to the present embodiment.
Figure 12:
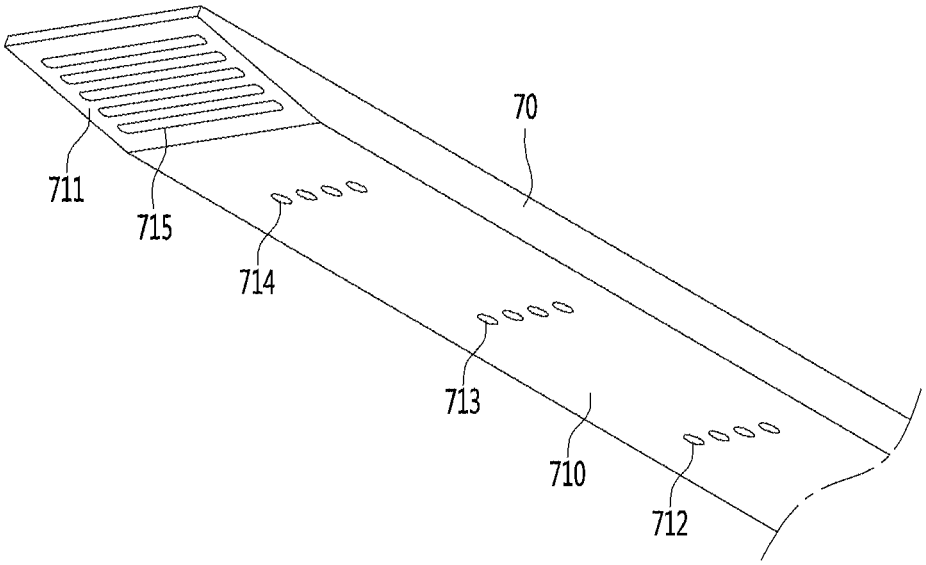
FIG. 12 is a perspective view of the door discharge duct when viewed from the bottom.

FIG. 11 is a view illustrating when the cooling air duct 60 communicates with the door discharge duct 70, and FIG. 12 is a perspective view of the door discharge duct 70 when viewed from the bottom. Referring to FIGS. 6 to 12, the door discharge duct 70 may communicate with the first cooling air outlet 611, and the second cooling air outlet 612 may be exposed to the refrigerating compartment 112.

A fluid passage allowing the flow of air may be formed inside the door discharge duct 70. One or more first discharge holes 712, 713, and 714 may be formed in the bottom surface of the door discharge duct 70 to discharge the cooling air. Since the door discharge duct 70 is positioned on the ceiling of the refrigerating compartment 112, the cooling air discharged through the one or more first discharge holes 712, 713, and 714 may flow into the upper space of the refrigerating compartment 112. The one or more first discharge holes 712, 713, and 714 may be arranged in a longitudinal direction (the front-rear direction of the refrigerating compartment 112) of the door discharge duct 70.

In addition, an inclination surface 711 may be formed at the front portion of the door discharge duct 70. The inclination surface 711 may be inclined upward toward the front portion (the door) of the refrigerating compartment 112. In addition, the inclination surface 711 may include a second discharge hole 715 to discharge the cooling air toward the refrigerating compartment door 16. The second discharge hole 715 may be positioned to face one component of the refrigerating compartment door 16. At least a portion of the second discharge hole 715 may be positioned to overlap the refrigerating compartment door 16 in a vertical direction.

Accordingly, an item stored in the refrigerating compartment door 16 may be cooled by the cooling air discharged through the second discharge hole 715. For example, a portion of the refrigerating compartment door 16 may be positioned under the second discharge hole 715 when the refrigerating compartment door 16 is closed.

Figure 13:
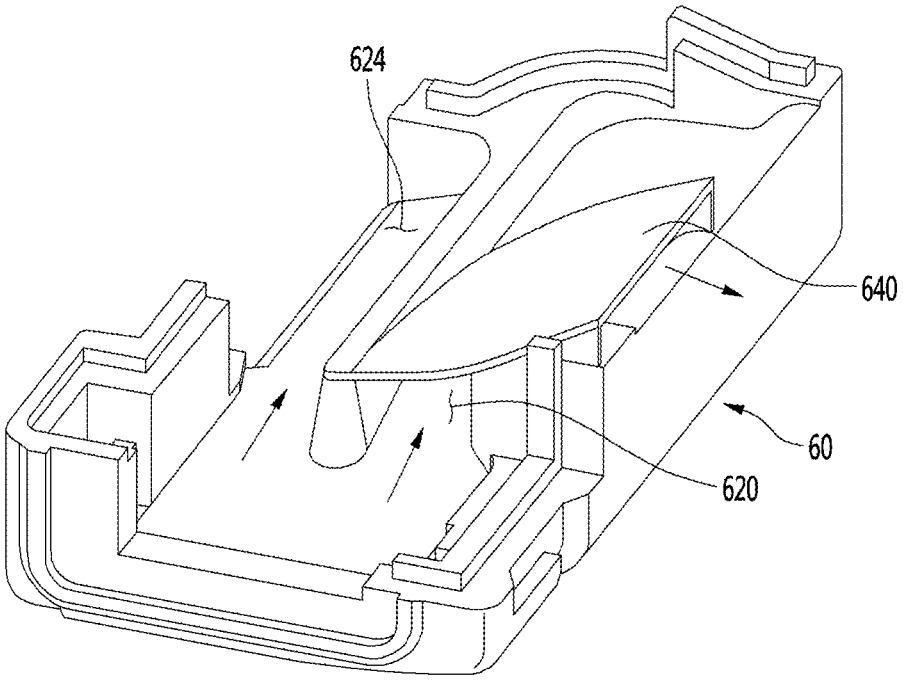
FIG. 13 is a view illustrating the flow of the cooling air in the cooling air duct when the damper is open at a first open angle according to the present embodiment.
Figure 14:
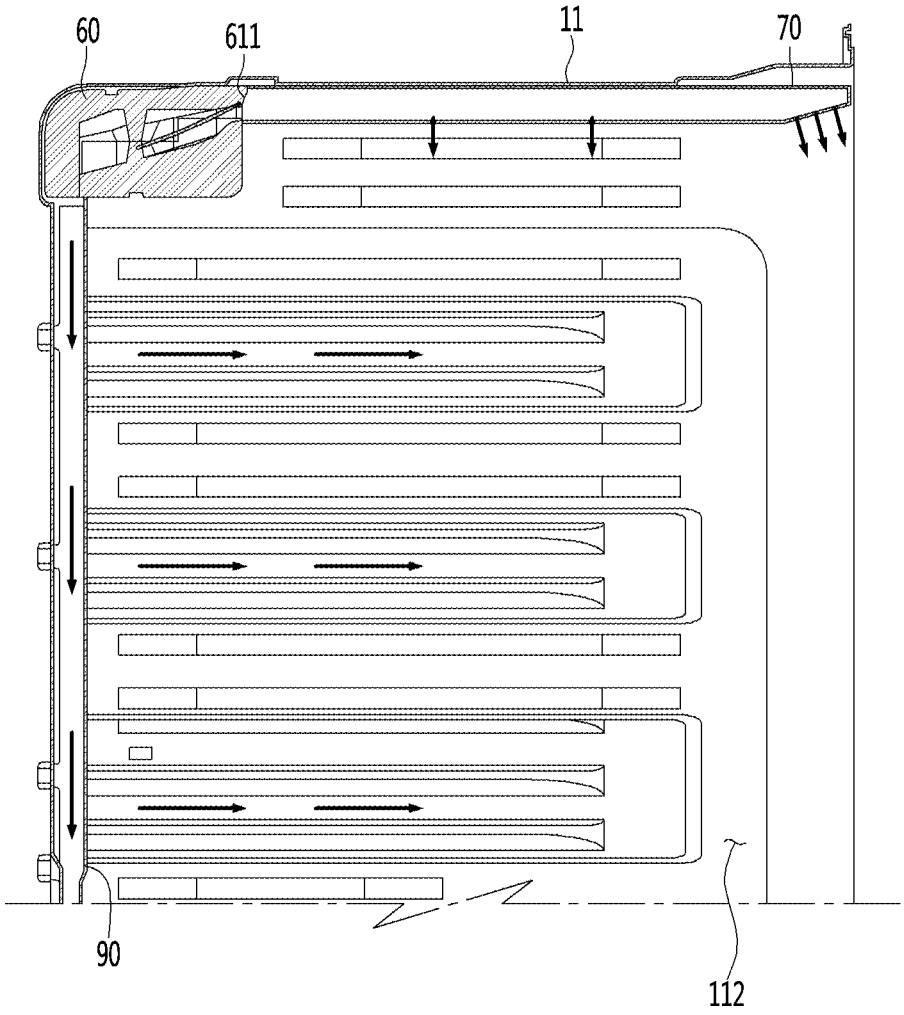
FIG. 14 is a view illustrating the flow of the cooling air in the refrigerating compartment when the damper is open at the first open angle according to the present embodiment.
Figure 15:
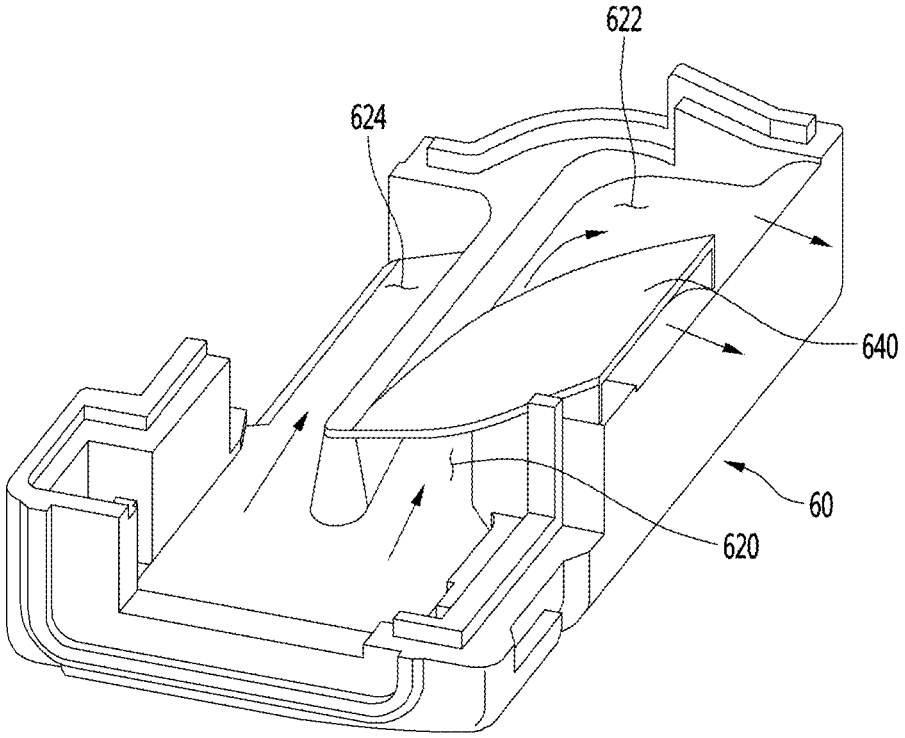
FIG. 15 is a view illustrating the flow of the cooling air in the cooling air duct when the damper is open at a second open angle according to the present embodiment.
Figure 16:
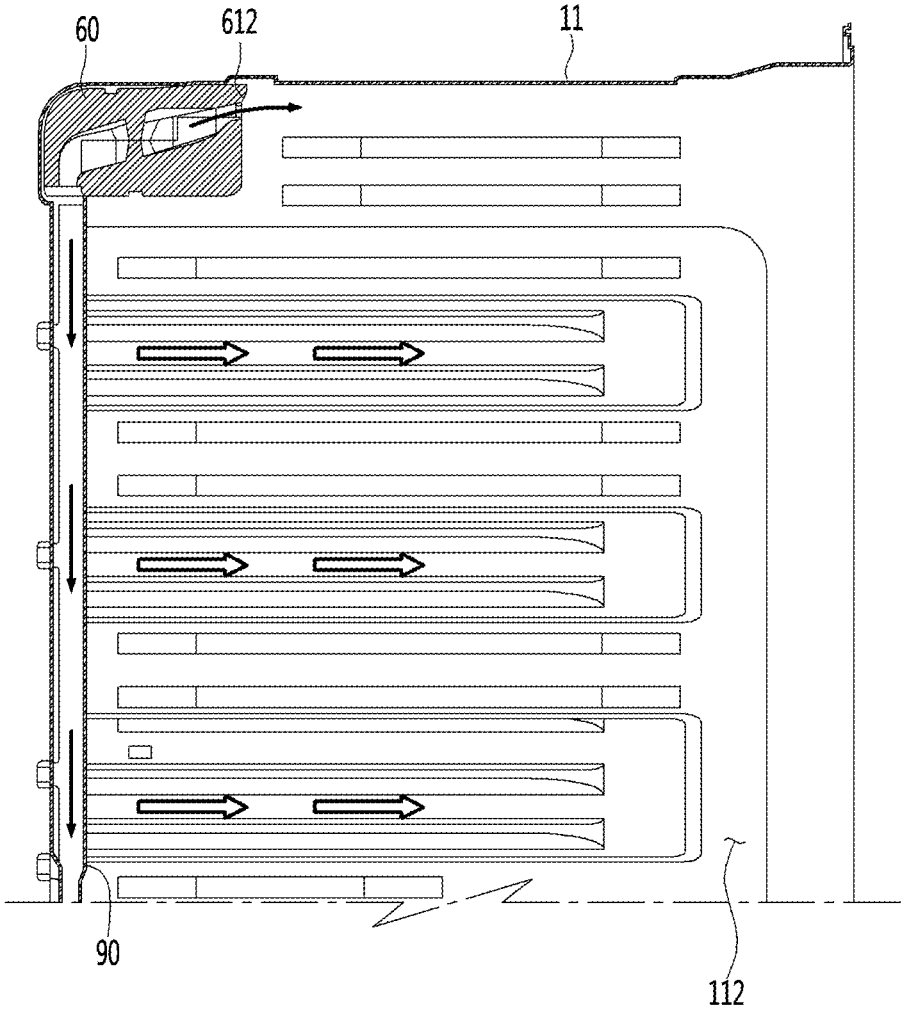
FIG. 16 is a view illustrating the flow of the cooling air in a refrigerating compartment when the damper is open at the second open angle according to the present embodiment.

FIG. 13 is a view illustrating the flow of the cooling air in the cooling air duct 60 when the damper 12 is open at a first open angle, and FIG. 14 is a view illustrating the flow of the cooling air in the refrigerating compartment when the damper is open at the first open angle. FIG. 15 is a view illustrating the flow of the cooling air in the cooling air duct when the damper is open at a second open angle, and FIG. 16 is a view illustrating the flow of the cooling air in the refrigerating compartment when the damper is open at the second open angle. FIG. 14 illustrates air flow through a portion of the cooling air duct 60 shown in FIG. 8, and FIG. 16 illustrates air flow through another portion of the cooling air duct 60 shown of FIG. 9.

In the following example, the first open angle of the damper 12 refers to an angle which is greater than zero degrees and equal to or greater than the minimum open angle of the damper 12. Furthermore, the second open angle of the damper 12 refers to an angle which is greater than the first open angle and equal to or greater than the maximum open angle of the damper 12.

First, referring to FIGS. 1 to 14, as described with reference to FIG. 5, the refrigerating compartment 112 may be maintained at the constant temperature by adjusting the open angle of the damper 12. When the refrigerating compartment 112 is maintained at the constant temperature, the damper 12 may be, for example, opened to the first open angle. When the damper 12 is rotated by the first open angle, the lower end portion of the damper 12 may be positioned lower than the inlet of the second cooling air passage 622. As described above, when the open angle of the damper 12 becomes the first open angle, the cooling air introduced through the cooling air inlet 610 may flow along the first cooling air passage 620 and the third cooling air passage 624.

The cooling air flowing along the first cooling air passage 620 is introduced into the door discharge duct 70 through the first cooling air outlet 611. A portion of the cooling air introduced into the door discharge duct 70 may be directly discharged to an upper portion of the refrigerating compartment 112 through the first discharge holes 712, 713, and 714, and another portion of the cooling air may be discharged toward the refrigerating compartment door 16 through the second discharge hole 715.

At the same time, the cooling air flowing along the third cooling air passage 624 may flow toward the rear discharge duct 90 via the third cooling air outlet 613. The cooling air may flow down within the rear discharge duct 90 to be discharged to the refrigerating compartment 112 through a plurality of cooling air holes 902.

Next, referring to FIGS. 15 and 16, when the temperature of the refrigerating compartment 112 is increased so that the temperature of the refrigerating compartment 112 needs to be decreased, the open angle of the damper 12 may be increased to the second, larger open angle. When the damper 12 is rotated to the second open angle, the lower end portion of the damper 12 may be positioned higher than the inlet of the first cooling air passage 620.

When the open angle of the damper 12 changes to the larger second open angle from the first open angle, the amount of the cooling air introduced through the cooling air inlet 610 may be increased. Furthermore, when the open angle of the damper 12 changes to the larger second open angle, as described above, the cooling air introduced through the cooling air inlet 610 may flow along not only the first cooling air passage 620 and the third cooling air passage 624, but also the higher second cooling air passage 622. Then, the cooling air flowing along the second cooling air passage 622 may be directly discharged to the refrigerating compartment 112 through the second cooling air outlet 612.

As previously described, when the refrigerating compartment 112 is being maintained at a constant temperature, the open angle of the damper 12 may be maintained at a relatively smaller angle to decrease an amount of cooling air flowing through the cooling air duct 60. When a smaller amount of air is supplied to the cooling air duct 60, this small amount of the cooling air may be discharged toward the refrigerating compartment door 16 through the door discharge duct 70 according to the present embodiment and discharged to an area adjacent to the refrigerating compartment door 16 in the refrigerating compartment 112. Accordingly, a temperature difference between an item stored in the refrigerating compartment door 16 and an item stored in the refrigerating compartment 112 may be reduced.

In addition, since the cooling air may flow toward the refrigerating compartment door 16 through the door discharge duct 70, the whole temperature of the refrigerating compartment 112 may be uniform. For example, since the cooling air of the refrigerating compartment 112 may be diffused throughout the entire portion of the refrigerating compartment 112 through the door discharge duct 70 and the rear discharge duct 90, the whole temperature of the refrigerating compartment 112 may be more uniform.

Figure 17:
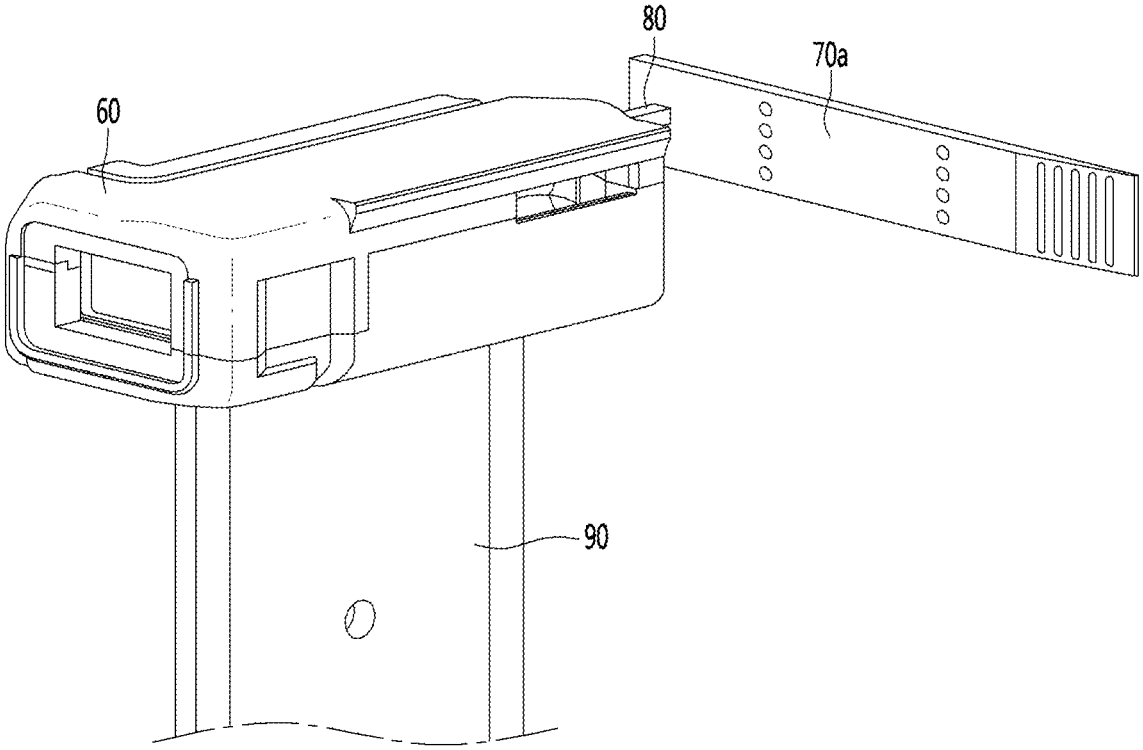
FIG. 17 is a view illustrating a door discharge duct according to another embodiment of the present disclosure.

FIG. 17 is a view illustrating the door discharge duct according to another embodiment. This other embodiment is similar to the previous embodiment shown in FIGS. 4, 11, and 14, except for an installation position of a door discharge duct 70*a* and a connection structure 80 included in the cooling air duct 60. Accordingly, hereinafter, only the features of the present embodiment will be described, and the description of the same features as those of the previous embodiment will be omitted and may be understood through the description of the previous embodiment.

Referring to FIG. 17, according to the present embodiment, a door discharge duct 70*a* may have a shape similar to the door discharge duct 70 according to the previous embodiment and may be positioned on the sidewall of the refrigerating compartment 112. Since the door discharge duct 70*a* may positioned on the sidewall of the refrigerating compartment 112, the connection duct 80 may be additionally include to provide a path for the cooling air to the door discharge duct 70*a*.

The connection duct 80 may include one end communicating with the first cooling air passage (see 620 of FIG. 8) and an opposite end connected with the door discharge duct 70*a*. For example, the connection duct 80 may be connected with the partition part (see, reference numeral 640 of FIG. 7) after passing through the side surface of the cooling air duct 60. Since the connection duct 80 connects the first cooling air passage 620 with the door discharge duct 70*a*, a first cooling air outlet (not illustrated) may be formed in the partition part (see, reference numeral 640 of FIG. 7). For example, the first cooling air outlet 611 may be removed from the front surface of the frame 600 in this second embodiment. Furthermore, in the present embodiment of FIG. 17, the first cooling air outlet (not illustrated) may be formed in the partition part (see, reference numeral 640 of FIG. 7).

According to the present embodiment, since the temperature of the storage compartment may be uniformly maintained, the storage period of an item stored in the storage compartment may be increased. For example, the foods stored in the storage compartment may be prevented from being excessively cooled or withered.

According to the present embodiment, even if a small amount of cooling air is supplied to the cooling air duct 60, the cooling air may be discharged toward the refrigerating compartment door 16 through the door discharge duct 70*a* according to the present disclosure and may be discharged from the refrigerating compartment 112 toward an area adjacent to the refrigerating compartment door 16, the temperature deviation of the article stored in the refrigerating compartment door 16 may be reduced.

In the following discussion, the door discharge duct may be referred to as a first discharge duct and the rear discharge duct may be referred to as a second discharge duct. Although the above embodiment has been described regarding a type of a refrigerator that creates and circulates cooling air by using one evaporator, the concepts may be identically applied to another type of a refrigerator that creates cooling air by using a first evaporator for a freezing compartment 111 and another evaporator for a refrigerating compartment 112. In this other example, the cooling air duct 60 may receive cooling air from the evaporator for the refrigerating compartment 112.

In addition, the method for controlling the damper may be similarly applied to the control of the compressor or the evaporator fan. For example, the method for controlling the damper may similarly control an activity of the compressor and/or the a rotational speed of the fan in a similar control pattern as that of the above-described method for controlling the open angle of the damper. For example, the compressor may operate with at a relatively high (e.g., 100%) cooling power at the initial stage. When the temperature of the storage compartment is decreased and reaches the second reference temperature, the compressor may operate with the compressor at a minimum power level. In addition, when the temperature of the storage compartment raises to reach the third reference temperature while the compressor is operating at the delaying minimum power level, the power to the compressor may be changed to n percent of the initial cooling power level, and the value of "n" may be in the range of 0 to 100, such as 50%.

The present embodiment provides a refrigerator capable of constantly maintaining the temperature of a storage compartment to improve the freshness of a stored article. In addition, the present embodiment provides a refrigerator capable of minimizing the temperature deviation in the storage compartment.

According to one aspect of the present disclosure, a refrigerator may include a cabinet including a storage compartment, a storage compartment door to open or close the storage compartment, a cool air duct provided in the storage compartment and positioned at an upper portion of the storage compartment to discharge cool air to the storage compartment, a damper to adjust an amount of cool air introduced into the cool air duct, and a door discharge duct communicating with the cool air duct and extending in a front-rear direction toward the storage compartment door to discharge cool air received from the cool air duct to the storage compartment door.

According to another aspect of the present disclosure, a refrigerator may include a cabinet including a storage compartment, a storage compartment door to open or close the storage compartment, a cool air duct provided in the storage compartment and positioned at an upper portion of the storage compartment to discharge cool air to the storage compartment, a damper to adjust an amount of the cool air introduced through the cool air duct, and a door discharge duct communicating with the cool air duct to discharge cool air received from the cool air duct to the storage compartment door, and a rear discharge duct disposed on a rear surface of the storage compartment to discharge the cool air received from the cool air duct to the storage compartment.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet including a freezing compartment and a refrigerating compartment;

a freezing compartment door to open or close the freezing compartment;

a refrigerating compartment door to open or close the refrigerating compartment;

a cool air duct provided in the refrigerating compartment to supply cool air from the freezing compartment;

a damper to adjust an amount of cool air introduced into the cool air duct; and a door discharge duct communicating with the cool air duct and extending toward the refrigerating compartment door in a first direction to discharge cool air received from the cool air duct to the refrigerating compartment door, wherein the door discharge duct includes one or more discharge holes, and at least one of the one or more discharge holes is disposed adjacent to the refrigerating compartment door, and a length of the door discharge duct in the first direction is greater than a length of the cool air duct in the first direction, wherein the cool air duct includes:

a frame having a cool air inlet;

a first cool air passage positioned inside the frame and configured to direct cool air to the door discharge duct;

a second cool air passage positioned inside the frame and configured to direct cool air to the refrigerating compartment; and a partition to separate at least a portion of the first cool air passage from at least a portion of the second cool air passage.

2. The refrigerator of claim 1, wherein the door discharge duct includes a first discharge hole to discharge cool air into the refrigerating compartment and a second discharge hole to discharge cool air toward the refrigerating compartment door.

3. The refrigerator of claim 2, wherein an inclination surface is formed at an end portion of the door discharge duct, and the second discharge hole is formed in the inclination surface.

4. The refrigerator of claim 1, wherein the second cool air passage includes an inlet positioned above an inlet of the first cool air passage.

5. The refrigerator of claim 4, wherein the cool air duct includes a first cool air outlet and a second cool air outlet formed in a front surface of the frame, and the first cool air outlet discharges cool air from the first cool air passage and the second cool air outlet discharges cool air from the second cool air passage.

6. The refrigerator of claim 5, wherein the first cool air outlet is closer to the cool air inlet than the second cool air outlet.

7. The refrigerator of claim 5, wherein the first cool air outlet and the second cool air outlet are provided at a common height in the frame.

8. The refrigerator of claim 5, wherein the door discharge duct is mounted on a ceiling of the refrigerating compartment.

9. The refrigerator of claim 4, wherein the door discharge duct is positioned on a sidewall of the refrigerating compartment, wherein the first cool air outlet is formed in the partition to discharge the cool air of the first cool air passage, and wherein the door discharge duct is connected to a connection duct connected to the first cool air outlet.

10. The refrigerator of claim 1, wherein the damper is rotatably mounted in the cool air duct.

11. The refrigerator of claim 10, wherein an upper end of the damper is rotatably mounted in the cool air duct, and wherein the damper is provided such that a height of a lower end of the damper is increased as an open angle of the damper is increased.

12. The refrigerator of claim 4, further comprising:

a rear discharge duct provided on a rear surface of the freezing compartment to discharge cool air received from the cool air duct to the refrigerating compartment, wherein the cool air duct further includes:

a third cool air passage that supplies cool air toward the rear discharge duct; and a third cool air outlet to discharge cool air to the rear discharge duct.

13. The refrigerator of claim 1, wherein the refrigerating compartment door includes a sub-door.

14. A refrigerator comprising:

a cabinet including a storage compartment;

a storage compartment door to open or close the storage compartment;

a cool air duct provided in the storage compartment to supply cool air and to include a cool air inlet;

a damper to open and close the cool air inlet and to adjust an amount of cool air supplied through the cool air duct;

a door discharge duct communicating with the cool air duct to discharge cool air received from the cool air duct to the storage compartment door; and a rear discharge duct provided on a rear surface of the storage compartment to discharge the cool air received from the cool air duct into the storage compartment, wherein the cool air duct includes:

a first cool air outlet to discharge cool air toward the door discharge duct;

a second cool air outlet to discharge cool air into the storage compartment;

a first cool air passage to direct the cool air to the first cool air outlet; and a second cool air passage to direct the cool air to the second cool air outlet, wherein in a state in which the storage compartment door closes the storage compartment:

wherein a portion of the second cool air passage is disposed above the first cool air passage, and the portion of the second cool air passage overlaps the first cool air passage in a vertical direction, when the damper is moved to a first position to open the cool air inlet, the cool air introduced through the cool air inlet flows to the first cool air outlet, and when the damper is moved from the first position to a second position to open the cool air inlet, the flow of the cool air is changed such that the cool air introduced through the cool air inlet flows to the first cool air outlet and the second cool air outlet.

15. The refrigerator of claim 14, wherein the door discharge duct includes a plurality of discharge holes spaced apart from each other in a front-rear direction, and wherein the rear discharge duct includes a plurality of discharge holes spaced apart from each other in an up-down direction.

16. The refrigerator of claim 14, wherein the cool air duct includes:

a third cool air outlet to discharge cool air toward the rear discharge duct, wherein in a state in which the storage compartment door closes the storage compartment:

when the damper is moved to the first position to open the cool air inlet, the cool air introduced through the cool air inlet flows to the first cool air outlet and the third cool air outlet, when the damper is moved from the first position to the second position to open the cool air inlet, the flow of the cool air is changed such that the cool air introduced through the cool air inlet flows to the first cool air outlet, the second cool air outlet and the third cool air outlet.

17. A refrigerator comprising:

a cabinet defining a storage compartment;

a door to open or close the storage compartment; and a cool air duct provided in the storage compartment to supply cool air, the cool air duct including:

a first cool air outlet and a second cool air outlet;

a damper having a top end that is rotatably mounted in the cool air duct, the damper being rotated around the top end to adjust a height of a lower end of the damper, a first cool air passage having an inlet to receive cool air from the damper, the first cool air passage directing cool air to the first cool air outlet; and a second cool air passage having an inlet positioned above the inlet of the first cool air passage, the second cool air passage directing cool air to the second cool air outlet, a discharge duct coupled to the first cool air outlet and extending toward the door to discharge cool air toward the door, wherein cool air is directed to the inlet of the first cool air passage when a height of the lower end of the damper is below a threshold, and cool air is directed to the inlet of the first cool air passage and the inlet of the second cool air passage when the height of the lower end of the damper is above the threshold, and wherein the second first cool air outlet outputs cool air into the storage compartment.

18. The refrigerator of claim 17, wherein the cool air duct further includes a partition to separate at least a portion of the first cool air passage from at least a portion of the second cool air passage, and wherein cool air is supplied above the partition when the height of the lower end of the damper is above the threshold.

19. The refrigerator of claim 17, wherein an amount of cool air supplied by cool air duct to the storage compartment varies based on the height of the lower end of the damper.

* * * * *